United States Patent [19]

Saito et al.

[11] Patent Number: 4,840,558

[45] Date of Patent: Jun. 20, 1989

[54] PULSATING COMBUSTION SYSTEM

[75] Inventors: Kazuo Saito, Fujisawa; Toshihiko Saito; Ken Kishimoto, both of Tokyo, all of Japan

[73] Assignee: Kabushiki Kaisha Toshiba, Kawasaki, Japan

[21] Appl. No.: 137,666

[22] Filed: Dec. 24, 1987

[30] Foreign Application Priority Data

Jun. 26, 1987 [JP] Japan ..... 62-159041

[51] Int. Cl.[4] ..... F23C 11/04

[52] U.S. Cl. ..... 431/1; 60/39.77

[58] Field of Search ..... 431/1; 60/39.76, 39.77; 122/24; 432/58

[56] References Cited

U.S. PATENT DOCUMENTS

| | | | |
|---|---|---|---|
| 2,838,102 | 6/1958 | Reimers | 431/1 |
| 3,119,436 | 1/1964 | Rydberg | 431/1 |
| 3,447,878 | 6/1969 | Haag et al. | 431/1 |
| 3,469,929 | 9/1969 | Haag | 431/1 |
| 3,606,867 | 9/1971 | Briffa | 122/24 |
| 3,738,290 | 6/1973 | Belter | 431/1 X |
| 4,449,484 | 5/1984 | Sakamoto et al. | 122/13 R |
| 4,472,132 | 9/1984 | Hisaoka et al. | 431/1 |
| 4,477,246 | 10/1984 | Hisaoka et al. | 431/1 X |
| 4,484,885 | 11/1984 | Machii et al. | 431/1 |
| 4,639,208 | 1/1987 | Inui et al. | 431/1 |
| 4,687,435 | 8/1987 | Matsuzaka et al. | 431/1 |

OTHER PUBLICATIONS

Proceedings of 23rd National Heat Transfer Symposium of Japan by Ken Kishimoto p. 725 May 27, 1986.

Proceedings of Symposium on Pulse-Combustion Applications by B. S. Sran and J. A. C. Kentfield, p. 3, Mar. 1982.

*Primary Examiner*—Margaret A. Focarino

*Attorney, Agent, or Firm*—Cushman, Darby & Cushman

[57] ABSTRACT

A pair of pulsating combustors are parallelly connected to each other between an air intake chamber and an exhaust chamber. Aerodynamic valves having a forward flow coefficient higher than their reverse flow coefficient are respectively arranged in air intake pipes which connect the combustion chambers of the pulsating combustors to the air intake chamber. Fuel is injected into a location between each of the aerodynamic valves and a corresponding one of the combustion chambers. The injected fuel collides with an air stream flowing through each of the aerodynamic valves and is mixed therewith. When explosive combustion takes place in any one of the combustion chambers, injection of fuel thereto is automatically stopped by the pressure increase caused by the explosive combustion. When the pressure in the combustion chamber decreases, fuel is once again injected.

4 Claims, 6 Drawing Sheets

0MS: FUEL INJECTION

3MS: MIXING BY AIR INJECTION

6MS: REACTION INITIATED

8MS: REACTION IN PROGRESS

10MS: MOST-ACTIVATED REACTION

17MS: QUIESCENT PERIOD RE-INJECTION OF FUEL

PULSATING COMBUSTION SYSTEM

BACKGROUND OF THE INVENTION

The present invention relates to a pulsating combustion system wherein a plurality of pulsating combustors are coupled to each other in parallel.

It is known that a pulsating combustor has many advantages over a conventional burner, e.g., that the pulsating combustor can increase a combustion chamber load to about ten times larger than that of the conventional burner, can achieve high thermal efficiency, does not require a blower for supplying air, and can reduce a toxic component in the exhaust gas. Generally, a pulsating combustor is constituted by a combustion chamber, fuel and air supply lines for respectively supplying fuel and air into the combustion chamber, a tail pipe connected to an exhaust port arranged in the combustion chamber, a movable valve inserted in the fuel supply line, and an ignition system for igniting the gas mixture supplied into the combustion chamber. When the gas mixture in the combustion chamber is ignited, it is explosively burned. The pressure in the combustion chamber is increased so that the movable valve is automatically closed while the burnt gas is exhausted from the exhaust port at a high speed. Upon exhaustion of the gas, the pressure in the combustion chamber becomes a negative pressure (below the atmospheric pressure). The movable valve is then opened to cause the gas mixture to flow into the combustion chamber again. When a predetermined amount of gas flows into the combustion chamber, it is ignited by an after fire to be explosively burned again. The combustion cycle described above is repeated. The combustion in the pulsating combustor is an intermittent explosive combustion. For this reason, noise caused by the pulsating combustor is considerably large.

In order to eliminate this drawback, there is proposed a pulsating combustor, wherein a plurality of, e.g., two pulsating combustors are coupled to each other in parallel. In this pulsating combustion system, noise is reduced by configuring the phases of the strokes constituted by intake, explosive combustion, and exhaust in one of the pulsating combustors as shifted by 180° with respect to those in the other pulsating combustor. This enables and pressure variations between these phases to cancel each other. However, it is difficult to accurately shift the phases by 180° when mechanical movable valves are used to restrict a fluid flow and transmission of pressure variations to the downstream side because strong interference is not caused. Since the movable valves are reciprocated several tens of times per second, a problem of durability is also posed. When the mechanical movable valves are used, a CO—$CO_2$ characteristic is degraded if a combustion amount range must be widened. Therefore, a turn down ratio (a ratio of a minimum combustion amount to a rated combustion amount) is as low as 2:1 to 3:1 even in the maximum combustion amount range.

Thus, it is proposed in Proceedings of National Heat Transfer Symposium of Japan, p. 725; Ken Kishimoto; May 27, 1986 that in place of the mechanical valves, nozzle-like aerodynamic valves be used, wherein a forward flow coefficient is higher than a reverse flow coefficient. If the aerodynamic valves are used, oscillation cycles of the two pulsating combustors can be shifted by 180° because the pressures in the two combustion chambers strongly interfere with each other through the aerodynamic valves. Since no mechanically moved element is required, the problem of durability can be eliminated. The combustion amount range can be widened to such an extent that a turn down ratio of 10:1 can be obtained without degrading the CO—$CO_2$ characteristic.

However, even in the pulsating combustion system incorporating the aerodynamic valves, the following problems are present. In order to accurately shift the phases by 180° as described above, a gas mixture taken into the combustion chamber must be ignited at a predetermined timing. In order to prevent a delay in ignition timing, ignitability of the gas mixture must be improved by properly mixing fuel with air. However, in the conventional pulsating combustion system incorporating the aerodynamic valves, fuel and air tend to be insufficiently mixed because of the presence of the aerodynamic valves, resulting in a delay in ignition timing, an increase in noise, and degradation of combustibility. Since the combustion chamber communicates with an air intake system through the aerodynamic valve, when explosive combustion takes place in the combustion chamber, fuel flows into the air intake system by the pressure of explosive combustion. Hence, combustion may take place in the air intake system.

SUMMARY OF THE INVENTION

It is an object of the present invention to provide a pulsating combustion system, wherein excellent safety and durability are ensured, noise is minimized, stable combustion is maintained, a combustion amount range is widened, and a toxic component is reduced.

According to the present invention, there is provided a pulsating combustion system comprising at least a pair of combustion chambers having the same arrangement, air intake ports respectively formed in circumferential walls of the combustion chambers, tail pipes connected to exhaust ports respectively formed in the combustion chambers, air intake pipes, one end of each of which is connected to a corresponding one of the air intake ports, for supplying air required for combustion into the combustion chambers while converting the air into a turbulent flow flowing along the inner surfaces thereof, an air intake chamber to which the other end of each of the air intake pipes is commonly connected, an exhaust chamber to which the tail pipes connected to the exhaust ports of the combustion chambers are commonly connected, aerodynamic valves respectively arranged in the air intake pipes, each having a forward flow coefficient higher than their reverse flow coefficient, means for injecting fuel into a position between the aerodynamic valve in each of the air intake pipes and each of the air intake ports, ignitors respectively arranged in the combustion chambers, an air supply fan arranged in the air intake chamber or in an upstream portion thereof and means for starting the air supply fan and the ignitors at an operation start time.

According to the present invention, the combustion chambers communicate with each other through the aerodynamic valves inserted in the air intake pipes, and the air intake chamber. Each of the aerodynamic valves prevents burnt gas flowing into the air intake chamber when the pressure in the combustion chamber is increased upon explosive combustion. At the same time, the pressure in one of the combustion chambers, which is increased upon explosive combustion, is smoothly transmitted to the other combustion chamber in a negative pressure state through the air intake chamber. The high pressure in one of the combustion chambers and the negative pressure in the other combustion chamber can strongly interfere with each other, thereby establishing one of the conditions for shifting the combustion cycles of the pulsating combustors by 180°. Since fuel is injected into a location between each of the aerodynamic valves and a corresponding one of the air intake ports, fuel and air can be appropriately mixed because of an air stream flowing into the position at a high speed when the combustion chamber is in the negative pressure state. The arrangement in which air is supplied by the air intake pipe to form a turbulent flow in the combustion chamber also contributes to the above effect. Since fuel and air can be appropriately mixed in this manner and ignitability of the next cycle can be improved, ignition can be easily performed, and hence the combustion cycles of the pulsating combustors can be accurately shifted by 180°. As a result, low noise and stable combustion can be realized while a toxic component can be minimized. Since the high pressure in one of the combustion chambers and the negative pressure in the other combustion chamber can strongly interfere with each other, a combustion amount range can be widened. Since fuel is injected into the position in the air intake pipe as described above, when the pressure in the combustion chamber is increased upon explosive combustion, fuel injection can be automatically stopped, thereby ensuring safety.

DETAILED DESCRIPTION OF THE PREFERRED EMBODIMENT

Figure 1:
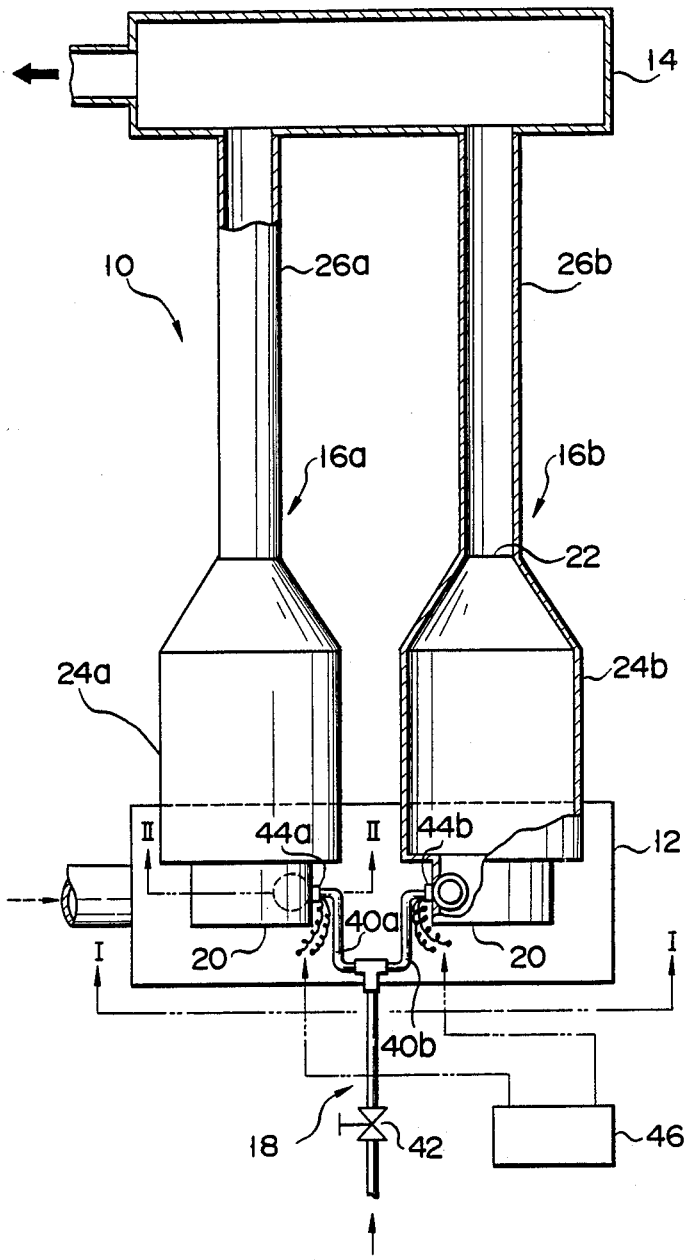
FIG. 1 is a partially cutaway plan view of a pulsating combustion system according to an embodiment of the present invention.
Figure 2:
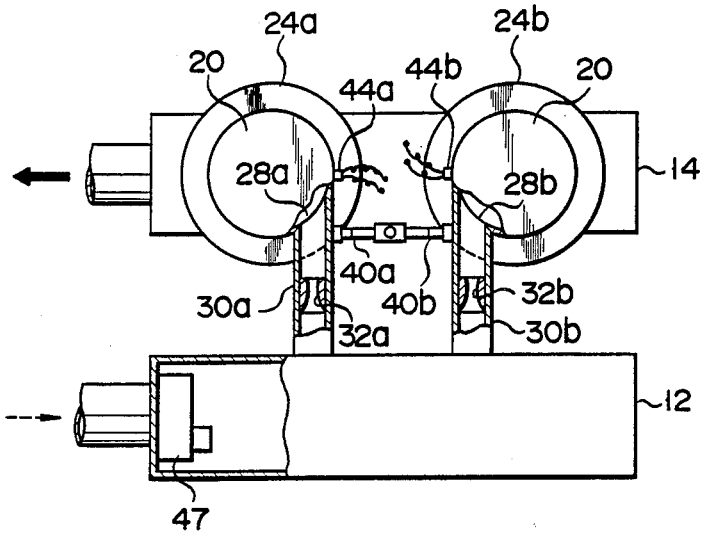
FIG. 2 is a partially cutaway view taken along a line I—I in FIG. 1 when viewed from the bottom thereof.

FIGS. 1 and 2 show main section 10 of a pulsating combustion system having two coupled pulsating combustors to which the present invention is applied. Main section 10 is constituted by air intake chamber 12, exhaust chamber 14, pulsating combustors 16*a* and 16*b* designed to have the same arrangement and size and parallelly coupled to each other to be located between air intake chamber 12 and exhaust chamber 14, and fuel supply system 18 for supplying fuel gas to pulsating combustors 16*a* and 16*b*. *Pulsating combustors 16a* and 16*b* comprise cylindrical combustion chambers 24*a* and 24*b* each having a bottom. One end of each of combustion chambers 24*a* and 24*b* is closed by closed wall 20, and exhaust port 22 is formed in the other end of each of combustion chambers 24*a* and 24*b*. Exhaust ports 22 of combustion chambers 24*a* and 24*b* are commonly connected to exhaust chamber 14 through tail pipes 26*a* and 26*b*, respectively. As shown in FIG. 2, air intake ports 28*a* and 28*b* are respectively formed in circumferential walls of combustion chambers 24*a* and 24*b* near closed walls 20. One end of each of air intake pipes 30*a* and 30*b* is connected to a corresponding one of air intake ports 28*a* and 28*b*. The other end of each of air intake pipes 30*a* and 30*b* is commonly connected to air intake chamber 12. Air intake pipes 30*a* and 30*b* are connected to air intake ports 28*a* and 28*b* such that the axes of air intake pipes 30*a* and 30*b* are perpendicular to the axes of combustion chambers 24*a* and 24*b*, respectively, in a staggered manner.

Figure 3:
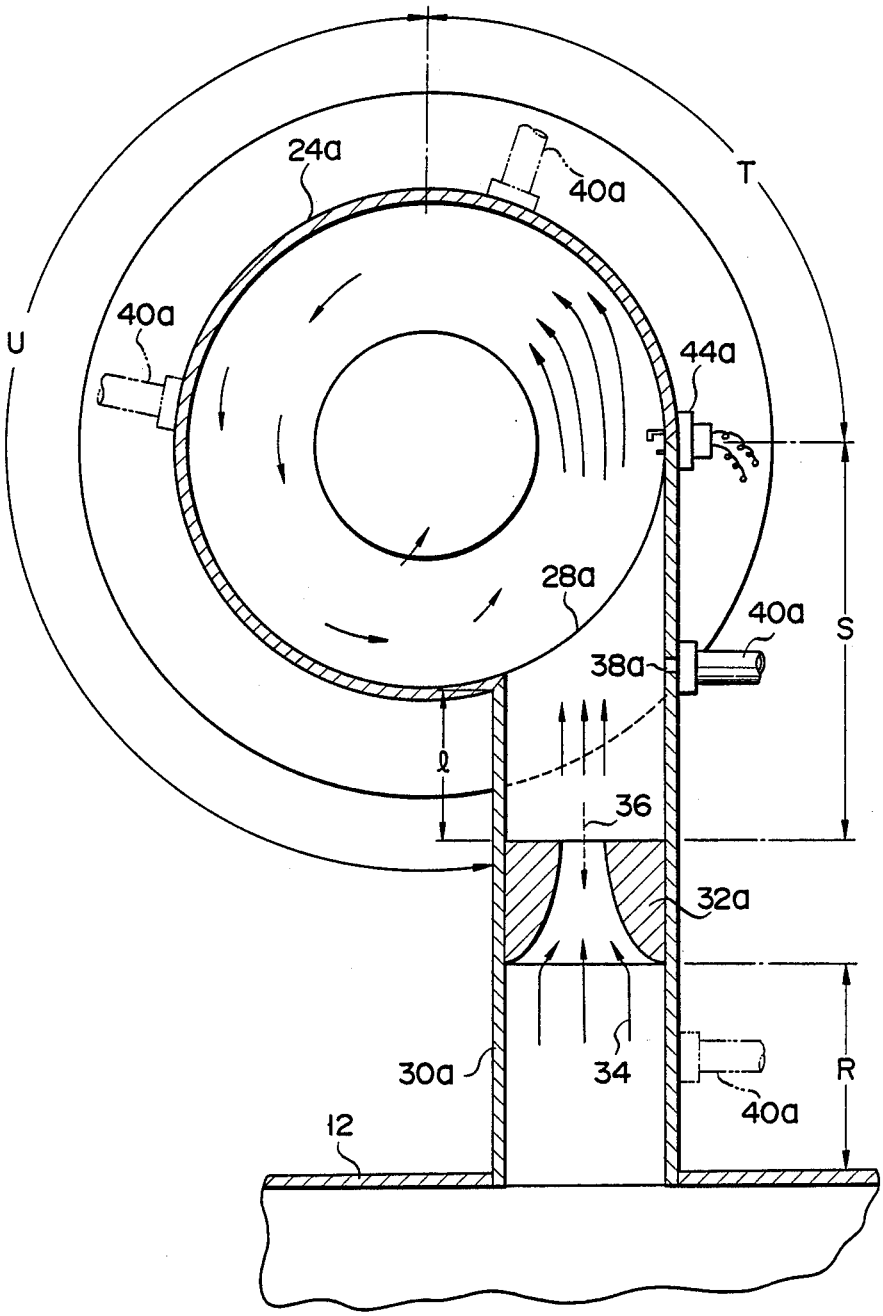
FIG. 3 is a sectional view taken along a line II—II in FIG. 1.

Aerodynamic valves 32*a* and 32*b* having a forward flow coefficient higher than their reverse flow coefficient are inserted at positions midway along air intake pipes 30*a* and 30*b*, respectively. As shown in FIG. 3, aerodynamic valves 32*a* and 32*b* are designed to have nozzle-like shapes whose opening areas are gradually decreased from the side of air intake chamber 12 toward the sides of combustion chambers 24*a* and 24*b*. More specifically, each of aerodynamic valves 32*a* and 32*b* is designed such that the flow resistance of a stream flowing from the upstream side to the downstream side, as indicated by solid arrows 34, is small, whereas the flow resistance of a stream flowing from the downstream side to the upstream side, as indicated by dotted arrow 36, is great.

As shown in FIG. 3, fuel injection ports 38*a* and 38*b* (fuel injection port 38*b* is not shown) are respectively formed in the circumferential walls of air intake pipes 30*a* and 30*b* between aerodynamic valves 32*a*, 32*b*, and air intake ports 28*a* and 28*b*. One end of each of fuel supply pipes 40*a* and 40*b* is connected to a corresponding one of fuel injection ports 38*a* and 38*b*, respectively. The other end of each of fuel supply pipes 40*a* and 40*b* is connected to a fuel gas source (not shown) through common valve 42.

Ignitors 44*a* and 44*b* are respectively arranged on the circumferential walls of combustion chambers 24*a* and 24*b* at boundary positions between combustion chambers 24*a* and 24*b* and air intake pipes 30*a* and 30*b*, which are located furthest from air intake chamber 12, in such a manner that discharge gap portions are located in combustion chambers 24*a* and 24*b*. Input terminals of ignitor 44*a* and 44*b* are connected to ignition power supply unit 46. In response to a start instruction, ignition power supply unit 46 applies start voltages to ignitors 44*a* and 44*b* for a short period of time according to a relationship described later. Air supply fan 47 is arranged in air intake chamber 12 to supply air to combustion chambers 24*a* and 24*b* in the standby state.

The pulsating combustion system shown in FIGS. 1 to 3 is operated as follows.

At an operation start time, air supply fan 47 is operated to purge the gas combusted or non-combusted in the previous combustion operation. A start instruction is supplied to ignition power supply unit 46. Unit 46 supplies an electrical ignition signal to ignitors 44*a* and 44*b*. Spark discharge occurs in a discharge gap portion of ignitor 44*a* in accordance with this electrical signal. In this state, when valve 42 is opened, fuel gas is injected into combustion chambers 24*a* and 24*b* through fuel supply pipes 40*a* and 40*b*, and fuel injection ports 38*a* and 38*b*. At this time, fuel is mixed with the already supplied air to obtain a gas mixture, and the mixture is ignited by ignitors 44*a* and 44*b*, thus causing explosive combustion.

When explosive combustion takes place in combustion chamber 24*a*, the pressure in combustion chamber 24*a* is rapidly increased. The front face pressure of fuel injection port 38*a* is also increased. As a result, fuel injection into combustion chamber 24*a* is automatically stopped. When the pressure in combustion chamber 24*a* is rapidly increased, most of the burnt gas flows through tail pipe 26*a* toward exhaust chamber 14 at a high speed. The remaining gas tends to flow through aerodynamic valve 32*a* toward air intake chamber 12. Aerodynamic valve 32*a* has a great resistance to a flow flowing from combustion chamber 24*a* toward air intake chamber 12. The burnt gas flowing into air intake chamber 12 is limited to a small amount. Changes in pressure in combustion chamber 24*a* are transmitted to air intake chamber 12. The amount of air flowing into combustion chamber 24*b* is increased upon transmission of the changes in pressure. When the burnt gas in combustion chamber 24*a* flows into tail pipe 26*a* at a high speed, the pressure in combustion chamber 24*a* is rapidly decreased to a negative pressure (below the atmospheric pressure) due to inertia of the combusted gas in tail pipe 26*a*. Therefore, fuel injection through fuel injection port 38*a* is restarted, air flows into combustion chamber 24*a* through aerodynamic valve 32*a* at a high speed. In this case, the air stream flowing into combustion chamber 24*a* through aerodynamic valve 32*a* collides with the fuel gas injected from fuel injection port 38*a*, and forms a turbulent flow flowing along the inner surface of combustion chamber 24*a*. Fuel and air are appropriately mixed and combustion chamber 24*a* is filled with the gas mixture of fuel gas and air again. At this time, after fire is present in combustion chamber 24*a* The gas mixture is ignited by the after fire, and explosively burned again.

A spark discharge state is also set at the discharge gap portion of ignitor 44*b*. The gas mixture in combustion chamber 24*b* is ignited by the spark discharge, and explosively burned. When the pressure in combustion chamber 24*b* is increased, fuel injection into combustion chamber 24*b* is automatically stopped. Most of the burnt gas flows through tail pipe 26*b* toward exhaust chamber 14 at a high speed. The remaining gas tends to flow through aerodynamic valve 32*b*. toward air intake chamber 12. Aerodynamic valve 32*b* has a great resistance to a flow flowing from combustion chamber 24*b* toward air intake chamber 12. Therefore, the burnt gas flowing into air intake chamber 12 is limited to a small amount. Changes in pressure in combustion chamber 24*b* are transmitted to air intake chamber 12. The amount of air flowing into combustion chamber 24*a* is increased upon transmission of the changes in pressure. When the fuel gas in combustion chamber 24*b* flows into exhaust chamber 14 at a high speed, the pressure in combustion chamber 24*b* is rapidly decreased to a negative pressure due to inertia. Fuel injection through fuel injection port 38*b* is restarted, air flows into combustion chamber 24*b* through aerodynamic valve 32*b* at a high speed. Since the air collides with the fuel gas to form a turbulent flow in combustion chamber 24*b*, fuel and air are appropriately mixed. Thus, combustion chamber 24*b* is filled with the gas mixture of fuel and air again. At this time, after fire is present in combustion chamber 24*b*. The gas mixture is ignited by the after fire, and explosively burned again. Thereafter, the above-described operation is repeated without using ignitors 44*a* and 44*b*, and shifted to a steady state operation. After the steady operating state is obtained, operations of air supply fan 47 and ignitors 44*a* and 44*b* are interrupted.

As is apparent from the above description, in the pulsating combustion system shown in FIGS. 1 to 3, explosive combustion takes place alternately in pulsating combustors 16*a* and 16*b*. The states of this steady state operation will be further described in detail with reference to FIGS. 4, and 5A to 5D.

Figure 4:
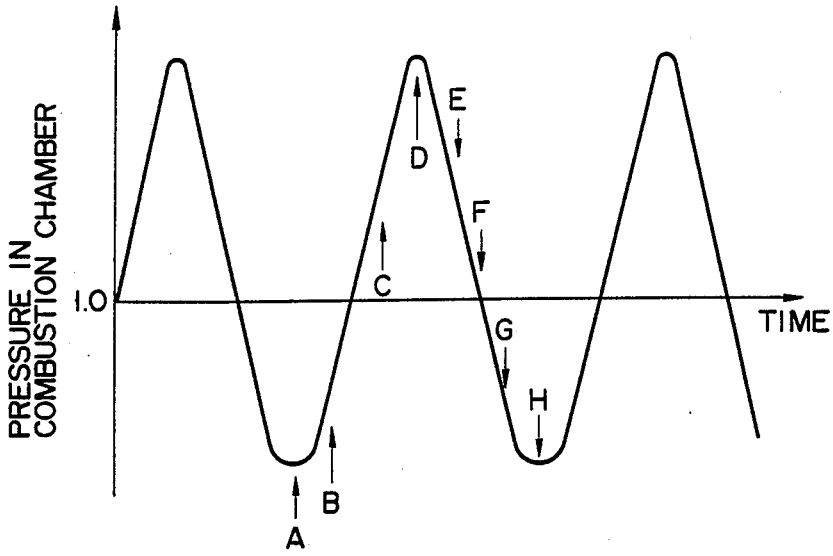
FIG. 4 is a graph showing changes in pressure in one of combustion chambers in the pulsating combustion system in FIG. 1 during a steady state operation.

FIG. 4 shows changes in pressure in combustion chamber 24*a* during the steady state operation. FIGS. 5A to 5D illustrate the combustion strokes constituted by intake of unburnt gas mixture, explosive combustion, and exhaust of burnt gas with the lapse of time. In FIGS. 5A to 5D, a flow of unburnt gas mixture, a flow of burnt gas, and a flow of air are indicated by hollow thin arrows, solid thick arrows, and dotted arrows, respectively.

Figure 5A:
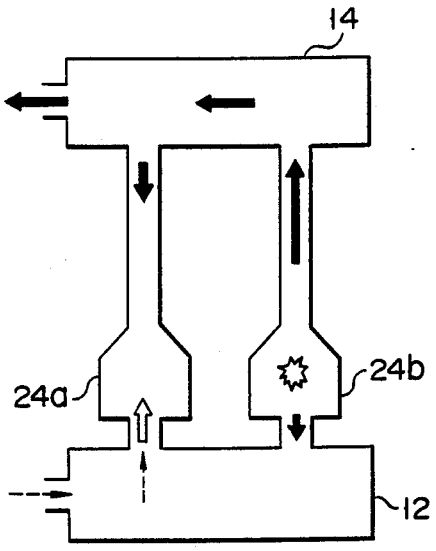
FIGS. 5A to 5D are views illustrating, with the lapse of time, combustion strokes which take place in two combustion chambers in the pulsating combustion system in FIG. 1 during the steady state operation.

FIG. 5A shows a state wherein the intake stroke takes place in combustion chamber 24*a*, while the exhaust stroke takes place in combustion chamber 24*b*. In this state, the pressure in combustion chamber 24*b* is negative, as indicated by arrow A in FIG. 4. The unburnt gas mixture flows into combustion chamber 24*a* through air intake port 28*a* while part of the burnt gas flows into combustion chamber 24*a* through tail pipe 26*a*.

Figure 5B:
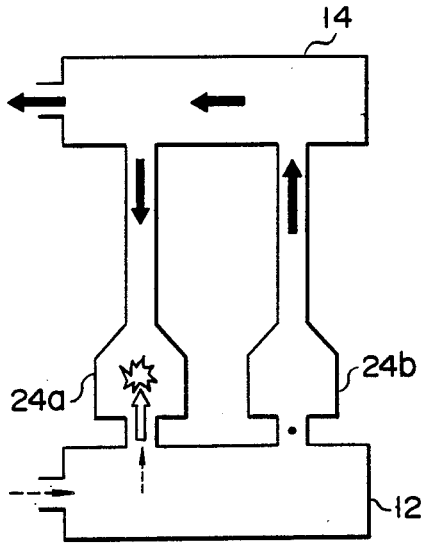
Figure 5C:
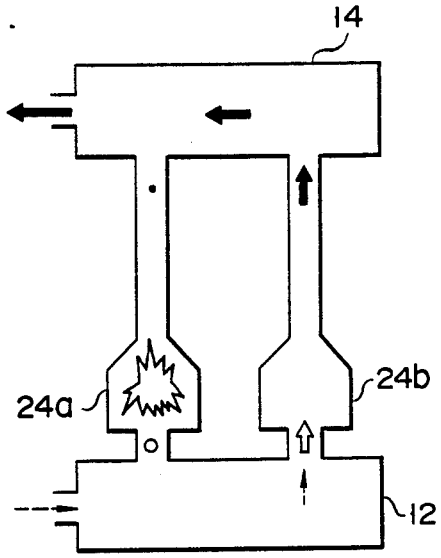

When a predetermined amount of unburnt gas mixture flows into combustion chamber 24*a*, it is ignited by after fire in combustion chamber 24*a*, and combustion of the unburnt gas mixture is started, as shown in FIG. 5*b*. As a result, the pressure in combustion chamber 24*a* begins to rise, as indicated by arrow B in FIG. 4. When combustion rapidly expands, the pressure in combustion chamber 24*a* becomes positive, as indicated by arrow C in FIG. 4. As a result, the flow of the unburnt gas mixture and exhaust gas into combustion chamber 24*a* is stopped, as shown in FIG. 5C. At this time, the pressure in combustion chamber 24*b* is negative, and hence the unburnt gas mixture begins to flow into combustion chamber 24*b* again.

Figure 6:
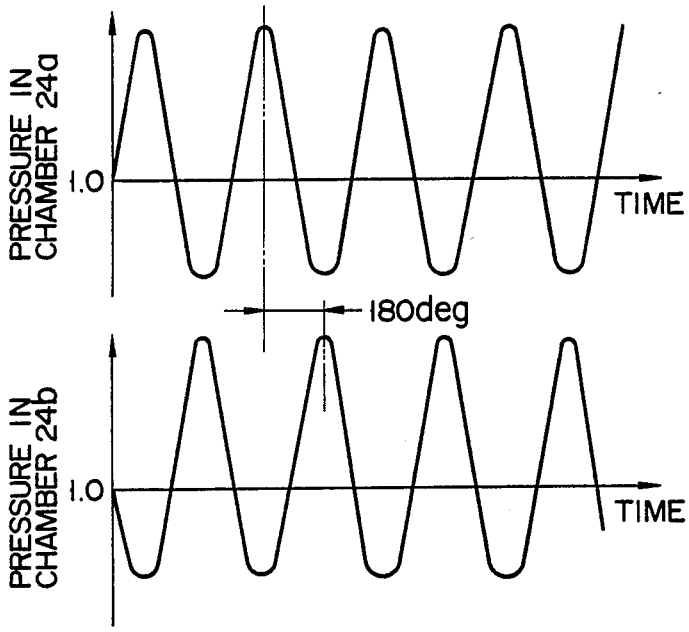
FIGS. 6 is a graph showing changes in pressure in the two combustion chambers in the pulsating combustion system in FIG. 1 during the steady state operation.
Figure 5D:
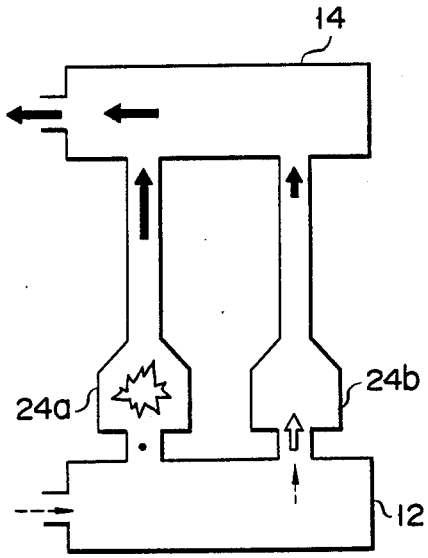
Figure 7A:
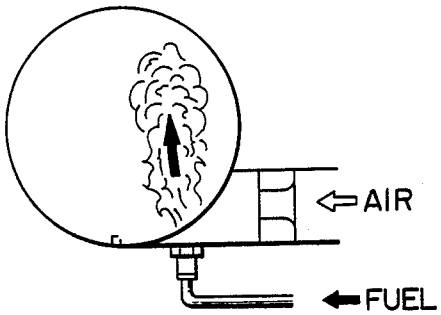
FIGS. 7A to 7F are views illustrating, with the lapse of time, the combustion stroke photographed by the Schlieren method, which takes place in one of the combustion chambers in the pulsating combustion system in FIG. 1 during the steady state operation.
Figure 7B:
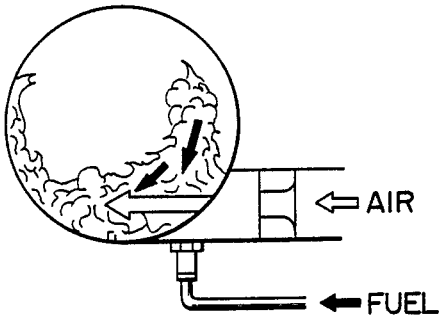
Figure 7C:
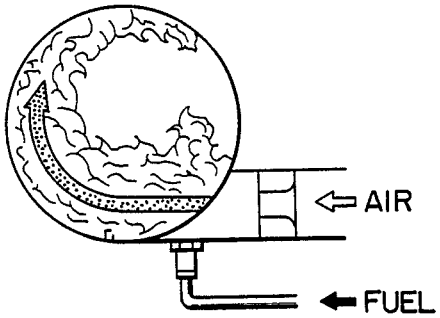
Figure 7D:
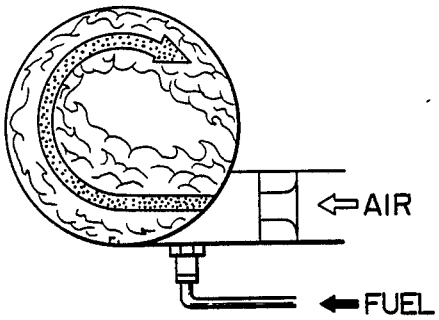
Figure 7E:
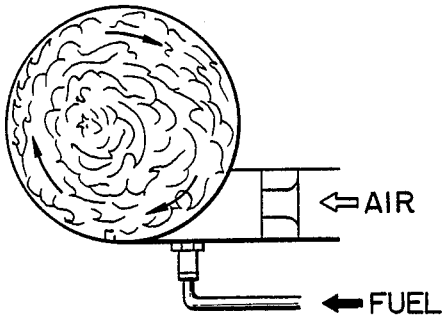
Figure 7F:
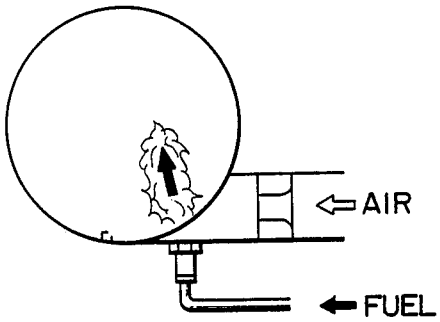

When main combustion is completed in combustion chamber 24*a*, the pressure in combustion chamber 24*a* reaches the maximum value, as indicated by arrow D in FIG. 4. Consequently, exhaust of the burnt gas from combustion chamber 24*a* is started, as shown in FIG. 5D. At this time, the unburnt gas continues to flow into combustion chamber 24*b*. When exhaust of the burnt gas from combustion chamber 24*a* is started, changes in pressure therein are transmitted to air intake chamber 12 through aerodynamic valve 32*a*. Upon transmission of the changes in pressure, the amount of air flowing into combustion chamber 24*b* through aerodynamic valve 32*b* is increased. Subsequently, combustion operation is performed in combustion chamber 24*b*. Explosive combustion is repeated alternately in pulsating combustors 16*a* and 16*b*. For this reason, explosive combustion takes place in a state wherein the oscillation cycles of pulsating combustors 16*a* and 16*b* are shifted by 180° during the pulsating combustion operation. The changes in pressure in combustion chambers 24*a* and 24*b* during the pulsating combustion operation correspond to a phase difference of 180°, as shown in FIG. 6. FIGS. 7A to 7F illustrate changes, with the lapse of time, in the combustion cycle in one of the combustion chambers during the steady state operation, which is photographed by the Schlieren method.

According to the embodiment, nozzle-like aerodynamic valves 32*a* and 32*b* are arranged in the positions midway along air intake pipes 30*a* and 30*b*, respectively. Opening areas of aerodynamic valve 32*a* and 32*b* are gradually reduced from the air intake chamber 12 side toward combustion chambers 24*a* and 24*b*. With the presence of aerodynamic valves 32*a* and 32*b*, unburnt gas can be intermittently introduced into combustion chambers 24*a* and 24*b*. In addition, the high pressure in one of the combustion chambers upon explosive combustion can be smoothly transmitted to the low pressure in the other combustion chamber through air intake chamber 12. More specifically, the high pressure in one of the combustion chambers can strongly interfere with the low pressure in the other combustion chamber through air intake chamber 12, thereby controlling changes in pressure. Accordingly, the phases of changes in pressure in combustion chambers 24*a* and 24*b* during pulsating combustion can be shifted by 180° so as to establish a condition necessary for a decrease in noise and widening of the combustion amount range. In addition, since fuel injection ports 38*a* and 38*b* are arranged in the circumferential walls of air intake pipes 30*a* and 30*b* at the positions between aerodynamic valves 32*a* and 32*b*, and combustion chambers 24*a* and 24*b*, air and fuel can be appropriately mixed, thereby facilitating ignition. As a result, the phases of changes in pressure in combustion chambers 24*a* and 24*b* can be accurately shifted by 180°, and hence a decrease in noise, and widening of the combustion amount range can be reliably realized. Moreover, since ignitability can be improved, a toxic component can be reduced and safety can be reliably ensured.

The reasons for the above will be described in detail below. When combustion is repeated at a short cycle as in the case of pulsating combustion, it is important how to increase the speed of mixing fuel with air.

When explosive combustion takes place in combustion chambers 24*a* and 24*b*, the pressures in the upstream sides of aerodynamic valves 32*a* and 32*b* (air intake chamber 12 side) are not increased as high as those in the downstream sides of aerodynamic valves 32*a* and 32*b*. If fuel injection ports 38*a* and 38*b* are arranged in the upstream sides of aerodynamic valves 32*a* and 32*b*, i.e., a zone indicated by reference symbol R in FIG. 3, injection of the fuel gas cannot be stopped by the pressure resulting from explosive combustion in the explosive combustion cycle. As a result, the fuel gas flows into air intake chamber 12 in the explosive combustion cycle, and the resultant gas mixture may be ignited by the fire transmitted through aerodynamic valves 32*a* and 32*b*. It is not preferable to connect the fuel injection ports to the R zone.

When fuel injection ports 38*a* and 38*b* are connected to a zone indicated by reference symbol S in FIG. 3, the front face pressures of fuel injection parts 38*a* and 38*b* are increased because of the presence of aerodynamic valves 32*a* and 32*b* during explosive combustion. Therefore, injection of the fuel gas can be automatically stopped, the fuel gas does not flow into air intake chamber 12. In addition, when the pressures in combustion chambers 24*a* and 24*b* are negative, the air streams flowing through aerodynamic valves 32*a* and 32*b* at a high speed collide with the fuel gas injected from fuel injection ports 38*a* and 38*b*. The fuel gas and the air can be appropriately mixed, and excellent ignitability and combustibility can be realized. Since fuel supply pipes 40*a* and 40*b* need not be directly connected to the circumferential walls of combustion chamber 24*a* and 24*b*, operability for maintenance of the fuel supply pipes can be improved.

In a zone indicated by reference symbol T in FIG. 3, the air stream flowing into combustion chamber 24*a* at a high speed is gradually decelerated. If fuel injection ports 38*a* and 38*b* are connected to the T zone, air and fuel gas are not properly mixed. Ignitability and combustibility are not good. Operability for maintenance of fuel supply pipes 40*a* and 40*b* is adversely affected.

In a zone indicated by reference symbol U in FIG. 3, the air stream flows at a considerably low speed. Therefore, fuel and air are mixed at a low speed. If fuel injection ports 38*a* and 38*b* are connected to the T zone, ignitability and combustibility are significantly degraded. Operability for maintenance of fuel supply pipes 40*a* and 40*b* is also adversely affected.

For the above reasons, fuel injection ports 38*a* and 38*b* are arranged in air intake pipes 30*a* and 30*b* at the positions between aerodynamic valves 32*a* and 32*b*, and combustion chambers 24*a* and 24*b*, i.e., in the S zone, respectively.

In the pulsating combustion system shown in FIGS. 1 to 3, if distance l between aerodynamic valve 32*a* (32*b*) and combustion chamber 24*a* (24*b*) shown in FIG. 3 is long, a desired effect cannot be obtained. Explosive combustion in the pulsating combustion system should take place within the combustion chamber, and hence it is not desirable for explosive combustion to take place in other places, e.g., in the air intake pipe. In the pulsating combustion system shown in FIGS. 1 and 3, the spaces in air intake pipes 30*a* and 30*b* between aerodynamic valves 32*a* and 32*b*, and combustion chambers 24*a* and 24*b* constitute additional spaces which locally extend the inner surfaces of combustion chambers 24*a* and 24*b* outwardly. The volume of the additional space is preferably set to be small. However, according to the experiments, it is found that the volume can be increased up to 10% of that of the combustion chamber without adversely affecting the combustion operation. In the pulsating combustor, normally, if the inner diameter of the combustion chamber is X, axial length Y of the combustion chamber is set as large as $Y=3X$. Inner diameter Z of air intake pipes 30*a* and 30*b* must be as large as $Z=(X/2)$ so as to increase the speed of air stream and form a turbulent flow in the combustion chamber. When the allowable value of l is obtained according to X, Y, and Z it is given as $l<1.2X$. Therefore, the above conditions must be satisfied.

The present invention is not limited to the above embodiment. For example, valves similar to the aerodynamic valves may be inserted in the fuel supply pipes to control changes in pressure in the fuel supply paths. With the above arrangement, noise can be further reduced. Furthermore, the number of pulsating combustors is not limited to one pair, but can be two pairs or more. Moreover, various changes and modifications can be made without departing from the spirit and scope of the invention.

What is claimed is:

1. A pulsating combustion system comprising:

at least two combustion chambers, each having a circumferential wall and an exhaust port and said chambers each having the same arrangement;

air intake ports respectively formed in and terminating at said circumferential walls of said combustion chambers;

tail pipes connected to said exhaust ports in said combustion chambers;

air intake pipe means, one end of each of which is connected to a corresponding one of said air intake ports, for supplying air required for combustion into said combustion chambers at said circumferential wall in a way such that a turbulent flow is caused along the inner surfaces thereof;

a common air intake chamber to which the other ends of each of said air intake pipe means are commonly connected;

an exhaust chamber to which said tail pipes are commonly connected;

valve means, one of which is arranged in each said air intake pipe means, for aerodynamically maintaining a forward flow coefficient higher than a reverse flow coefficient;

means for injecting fuel into each of said air intake pipe means at a location between said valve means and each of said air intake ports;

ignitors respectively arranged in said combustion chambers;

an air supply fan arranged in said common air intake chamber; and means for starting said air supply fan and said ignitors at an operation start time.

2. A system according to claim 1, wherein each of said valve means is an aerodynamic valve shaped like a nozzle, the opening area of which is gradually reduced from the air intake chamber side toward a corresponding one of said air intake ports.

3. A system according to claim 1, wherein $l < 1.2X$ when the distance between one of said valve means and a corresponding one of said combustion chambers is l, and the inner diameter of each of said combustion chambers is X.

4. A system as in claim 1 wherein combustion chambers is substantially cylindrical, said air intake pipe means causing a spiral flow along the inner surfaces of said cylindrical combustion chamber.

* * * * *